United States Patent [19]

Price et al.

[11] 4,268,924

[45] May 26, 1981

[54] SYPHON-OPERATED CLOSET BOWL FLUSH TANK

[76] Inventors: William Price, 7 Fletcher St.; Howard W. Ellison, 25 Burgess Ave., both of Warrington, England

[21] Appl. No.: 93,109

[22] Filed: Nov. 13, 1979

[30] Foreign Application Priority Data

Nov. 11, 1978 [GB] United Kingdom ..... 44166/78

[51] Int. Cl.[3] ..... E03D 1/08; E03D 1/14; E03D 3/12

[52] U.S. Cl. ..... 4/373; 4/324; 4/415

[58] Field of Search ..... 4/421, 661, 434, 324–327, 4/415, 368, 373, 375, 372, 344

[56] References Cited

U.S. PATENT DOCUMENTS

| | | | |
|---|---|---|---|
| 833,681 | 10/1906 | Denton | 4/373 |
| 1,270,506 | 6/1918 | Fite | 4/373 |
| 1,349,683 | 8/1920 | McCloud | 4/373 |
| 1,369,344 | 2/1921 | Larsen | 4/373 |
| 1,842,256 | 1/1932 | Embly | 4/373 |
| 2,452,394 | 10/1948 | Rigby | 4/373 |
| 3,663,969 | 5/1972 | Younger | 4/373 |
| 4,101,986 | 7/1978 | Ng et al. | 4/325 |

FOREIGN PATENT DOCUMENTS

| | | | |
|---|---|---|---|
| 3928 | of 1886 | United Kingdom | 4/373 |

*Primary Examiner*—Henry K. Artis

*Attorney, Agent, or Firm*—Larson, Taylor and Hinds

[57] ABSTRACT

A syphon-operated closet bowl flush tank of the kind comprising an inverted bell (10) containing a liftable plunger disc (12) to initiate syphon action has a flush control valve (14) comprising a tubular body part (16) mounted vertically in the top (18) of the bell and extending above the bell. The valve further has a stem (20) movable in and guided by the body part, is shaped to define a flow path (22) through the body part, and has lower (24) and upper (26) portions extending respectively below and above the top of the bell. The body part has a downwardly facing valve seat (25) inside the bell and the stem has an upwardly facing valve seat (31) co-operating with the downwardly facing seat to make a valve closure. An inverted bell float (38) is provided on the top of the stem. The body part includes a spring ring (30) carried in a flange (23) of the tubular body part so that the valve can be fitted to an existing bell by access from only the top of the bell. The valve permits the tank to be fully flushed or partially flushed depending on whether the plunger disc is retained lifted for the duration of the flush or is lifted and released immediately after the flush starts.

5 Claims, 2 Drawing Figures

SYPHON-OPERATED CLOSET BOWL FLUSH TANK

BACKGROUND OF THE INVENTION

The invention relates to syphon-operated closet bowl flush tanks.

It has already been appreciated that much water is wasted when flushing a closet bowl to dispose only of urine and efforts have been made to provide, on choice, a light or heavy flush. However systems known to us tend to be complex, unreliable or costly to instal.

SUMMARY OF THE INVENTION

It is one object of the present invention to provide a valve for a syphon-operated closet bowl flush tank which allows a light or heavy flush controlled respectively by the style of operation of the tank, namely, a light flush is derived from an initial operation followed by quick release and a heavy flush is derived from an initial operation which is then sustained.

It is a further object of the present invention, in the context of the above stated object, to provide such a valve which can be easily fitted to existing tanks.

It is a further object to provide such a valve which is inexpensive, is of simple construction, non-corrodable, of long life and replaceable by an acceptable fracture operation and has low adhesion risk.

The above stated objects are achieved in a syphon-operated closet bowl flush tank of the kind comprising an inverted bell containing a liftable plunger disc to initiate syphon action, the tank having a valve comprising:

(a) a tubular body part mounted vertically on the top of the bell and extending above said bell;

(b) a stem movable in and guided by the body part, shaped to define a flow path through the body part, and having lower and upper portions extending respectively below and above the top of the bell;

(c) a valve seat on a downward facing surface of the body part inside the bell;

(d) a co-operating valve seat on an upwardly facing surface on the lower portion of the valve stem; and (e) a float on the upper portion of the valve stem: arranged so that: with the bank filled with water, the float acts on the stem to urge the valve seats together; with the plunger lifted and retained lifted, the seats are held together; and with the plunger lifted and released immediately after the flush starts the float falls as water level falls so that the seats move apart to allow air to enter the bell when the water level reaches the top of the tubular body part to break the syphon and arrest the flush.

BRIEF DESCRIPTION OF THE DRAWINGS

The invention will now be described further with reference to the accompanying drawings in which.

DESCRIPTION OF THE PREFERRED EMBODIMENTS

Figure 1:
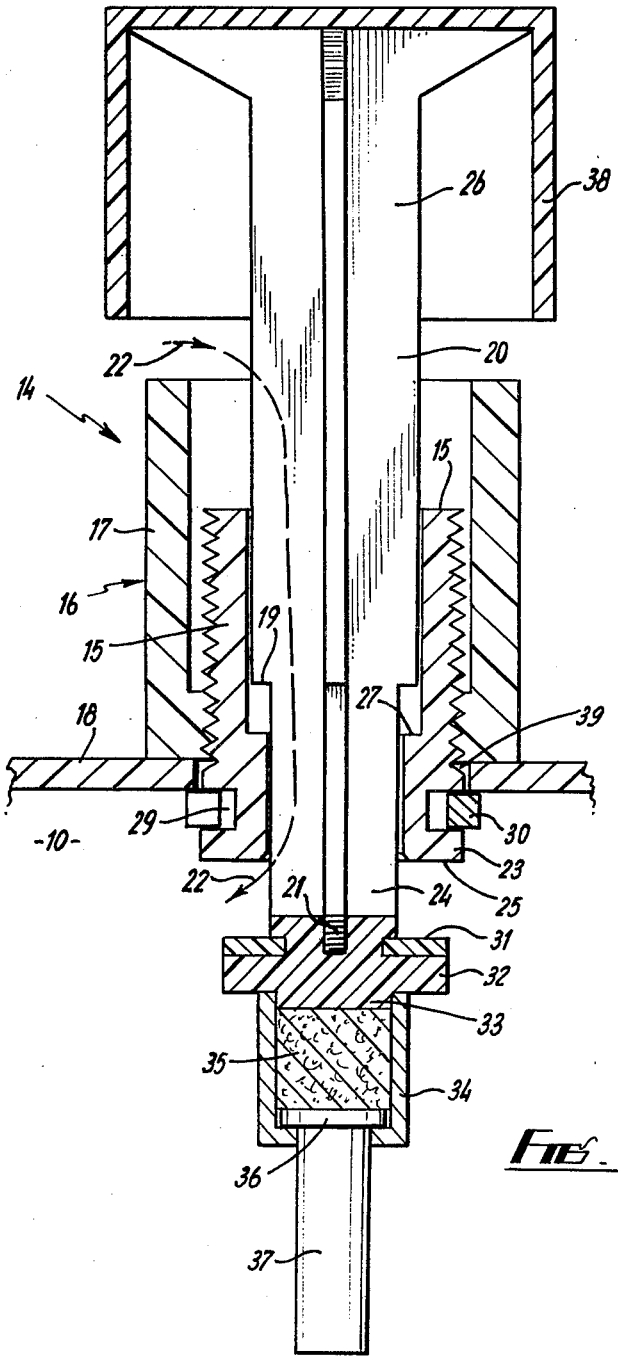
FIG. 1 is a cross-sectional elevation of a valve embodying the invention.

In FIG. 1 the top of a bell 10 of a syphon-operated closet bowl flush tank 40 (FIG. 2) is indicated by the item market 18. This bell contains (see FIG. 2) a liftable plunger disc 12 with a lifting rod 11 operable in the well-known manner to initiate a syphon action through a syphon tube 13. The tube 13 is shown discharging through the flush tank 40 (Arrow C).

Figure 2:
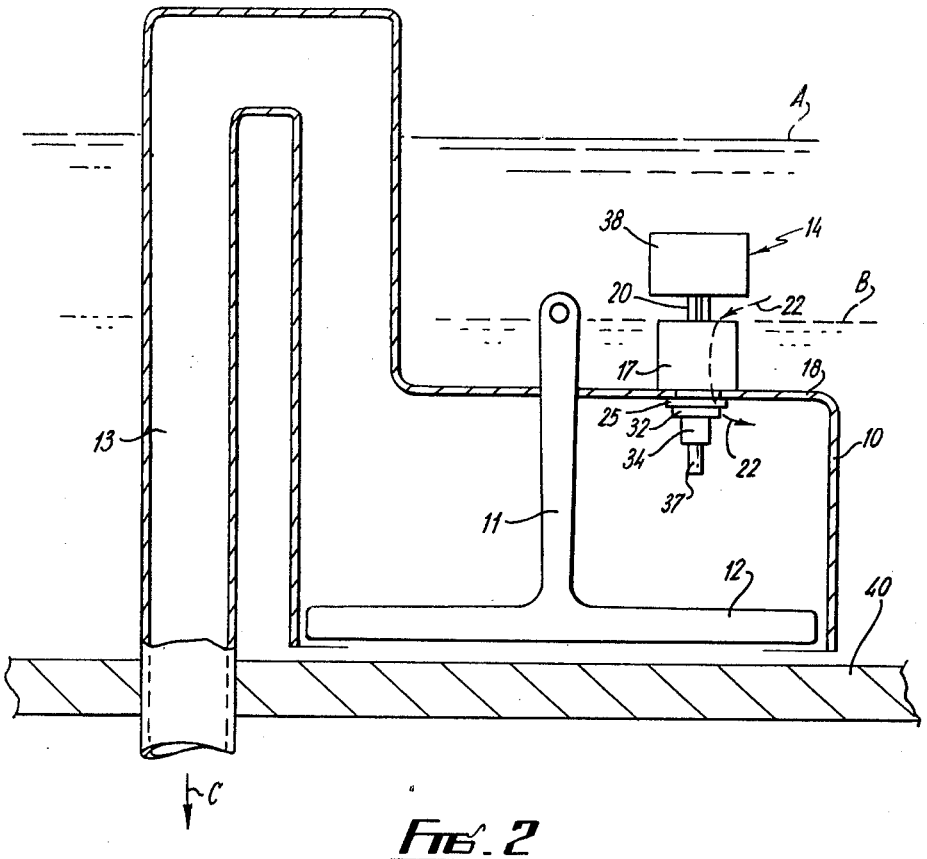
FIG. 2 is a diagrammatic cross-sectional elevation of the valve shown in FIG. 1 fitted in the top of a bell of a syphon-operated closet bowl flush tank.

Reverting to FIG. 1 the bell 10 has a flush control valve 14 shown approximately in the mid-point of its operation. The valve comprises a tubular body part 16 formed by an inner tube 15 and an outer tube 17 screw-threaded to the inner tube 15. The tube 17 extends above the top 18 of the bell and defines a level marked "B" (FIG. 2). The valve 14 has a stem 20 of cruciform cross-section which is movable up and down in, and is guided by, the inner tube 15. The cruciform cross-section defines a flow path 22 through the body part 16. The stem has a step 19, a lower portion 24 with a threaded pin 21 below the top 18 of the bell 10 and an upper portion 26 above the top 18.

The inner tube 15 of the body part 16 has a flange 23 which defines a downwardly facing valve seat 25 inside the bell 10, defines a step 27, and provides a groove 29 accommodating a split spring ring 30. The stem has an upwardly facing valve seat 31 for co-operation with the downwardly facing seat 25. The seat 31 is provided on a valve member 32 screw-attached to the threaded pin 21.

The valve member also has a step 33 at which is attached a cup 34 fitted with springy foam material 35. The cup supports the head 36 of a plunger 37.

The upper portion 26 of the stem 20 carries an inverted bell float 38.

All components of the valve 14 above described are made of cheap non-corrodable materials such as plastics or synthetic materials. The attachment of valve member 32 to the stem 20 and the attachment of the cup 34 to the valve member 32 can include cementing in order to give a long-life construction.

The plunger 37 can be of adjustable length to accommodate various syphon arrangements but preferably it is made oversize and simply cut to the correct length for its intended use.

To fit the valve 14 to an existing bell 10 a hole 39 is cut in the top 18 of the bell 10 and the valve lowered through the hole with the spring ring 30 compressed into the groove 29 to allow it to pass through the hole 39. Once through the hole 39 the ring 30 expands and becomes trapped under the top 18 of the bell. The outer tube 17 is then rotated on the inner tube 15 to draw the now expanded ring 30 against the under surface of the top 18 and thereby hold the valve firmly in the bell 10. A strictly water-tight seal is not essential.

As the flush tank 40 fills to the maximum level "A" the float 38 causes the stem 20 to rise until the seats 25 and 31 come together and the valve 14 remains in this position until the tank is flushed.

When the rod 11 and plunger 12 (FIG. 2) are raised in the operation of the tank, the plunger 12 reaches the plunger 37 and holds the seats 25 and 31 in contact regardless of the buoyancy of the float 38. Of course, the plunger 12 also primes the syphon 13 and a flush commences. If the plunger 12 is maintained in contact with the plunger 37 then a heavy flush takes place. If the plunger 12 is allowed to fall after the syphon has been primed then the stem 20 of the valve 14 falls as the water level in the tank falls. Eventually step 19 reaches step 27 and the stem is arrested in its downward movement with the seats 25 and 31 fully apart.

As the water level reaches level B air can enter the bell 10 via flow path 22 along the stem 20. This unprimes the syphon and the flush ceases so that a light flush takes place, that is a flush equal to the volume of water between levels A and B.

It is required to replace the valve 14 then the outer tube 17 can be tightened on the inner tube 15 until the part of the flange below the ring 30 fractures and the ring falls into the bell 10. Whether the fractured parts are recovered or not is not critical. They may become flushed away or they could remain on the plunger with little risk of causing trouble. In the last resort, or prudently, the bell could be removed for cleaning. Replacement is only considered to arise very rarely as the construction of the valve is such as to avoid corrosion and avoid close tolerances between moving parts which could cause jamming. A feature of the valve is that it is very lightly stressed at all times and is slow moving and cushioned and hence wear should be very slight with use. Risk of adhesion at the seats 25 and 31 is minimal.

Whilst the invention has been described above in the context of a valve to be fitted to an existing bell, the valve could also be fitted in the manufacture of a flush tank. For this purpose the body part could be made integral with the bell 10.

The top level of the body part 16 could be made adjustable by providing an adjusting collar so that the quantity of water flowing in a light flush is adjustable.

We claim:

1. In a syphon-operated closet bowl flush tank of the kind comprising an inverted bell containing a liftable plunger disc to initiate syphon action, a valve comprising:

(a) a tubular body part mounted vertically on the top of the bell and extending above said bell;

(b) a stem movable in and guided by the body part, shaped to define a flow path through the body part, and having lower and upper portions extending respectively below and above the top of the bell;

(c) a valve seat on a downward facing surface of the body part inside the bell;

(d) a co-operating valve seat on an upwardly facing surface on the lower portion of the valve stem; and (e) a float on the upper portion of the valve stem: arranged so that: with the tank filled with water, the float acts on the stem to urge the valve seats together; with the plunger lifted and retained lifted, the seats are held together; and with the plunger lifted and released immediately after the flush starts the float falls as water level falls so that the seats move apart to allow air to enter the bell when the water level reaches the top of the tubular body part to break the syphon and arrest the flush.

2. A tank as claimed in claim 1 in which the valve body part has a means permitting the valve to be fitted to the inverted bell of the tank by access from the top side of the bell only.

3. A tank as claimed in claim 1 in which said means comprises a split spring ring retained in a groove and compressible to allow the ring to pass through a hole in the top of said inverted bell and expandable to become trapped under the top of the bell.

4. A tank as claimed in claim 3 in which said groove is immediately above a frangible part of the valve so that, to remove the valve from the bell, said part can be fractured to release the spring ring from its groove and hence release the valve from the bell.

5. A tank as claimed in claim 1 in which the lowermost region of the stem has a plunger acting on the stem through the medium of springy plastics material, said plunger being exposed for impact by the plunger disc in the bell when the tank is flushed.

* * * * *